US005364494A

United States Patent [19]

Hutchison et al.

[11] Patent Number: 5,364,494

[45] Date of Patent: Nov. 15, 1994

[54] METAL DIE ACID ETCH APPARATUS AND PROCESS

[75] Inventors: Glenn E. Hutchison, Prairie Village; Richard L. Riddle, Overland Park, both of Kans.

[73] Assignee: Universal Engraving, Inc., Overland Park, Kans.

[21] Appl. No.: 159,081

[22] Filed: Nov. 29, 1993

[51] Int. Cl.[5] ..... B44C 1/22; C23F 1/00

[52] U.S. Cl. ..... 156/642; 156/637; 156/640; 156/345

[58] Field of Search ..... 156/345, 642, 656, 637, 156/640

[56] References Cited

U.S. PATENT DOCUMENTS 3,121,037 2/1964 Boitos ..... 156/642 X 3,494,815 2/1970 Yoshimatsu ..... 156/642 X

*Primary Examiner*—William Powell

*Attorney, Agent, or Firm*—Hovey, Williams, Timmons & Collins

[57] ABSTRACT

A metal die acid etch apparatus includes a bath for holding an acid etch solution and a hood assembly on which a metal die is supported above the bath. Structure is provided on the apparatus for exposing the metal die to the acid etch solution that is in the bath in order to etch the plate as desired. A weir is positioned at a predetermined height within the bath for draining acid solution from the top of the bath, and this drained solution is recirculated into the bath. The temperature of the acid etch solution in the bath is maintained at a predetermined temperature in order to provide a predictable and consistent etch of the metal die.

15 Claims, 6 Drawing Sheets

METAL DIE ACID ETCH APPARATUS AND PROCESS

BACKGROUND OF THE INVENTION

1. Field of the Invention

The present invention relates generally to etching devices and, more particularly, to a metal die acid etch apparatus having a bath of acid etch solution that is allowed to continuously overflow from a predetermined level at the top of the bath and to be at least partially recirculated.

2. Discussion of the Prior Art

A conventional metal die acid etch apparatus comprises an open-topped tank for holding an acid etch solution, and a hood assembly on which a metal die is supported over the tank. A plurality of paddle wheels or sprayers are provided in the tank for projecting the solution onto the metal die so that the solution etches the die as desired.

It is a known requirement in such conventional constructions that the temperature of the solution be maintained within about ±1° F. Accordingly, it is known to provide a heater and/or cooler which adjusts and maintains the temperature of the solution in the tank during an etching operation. It is also necessary, especially where paddle wheels are employed to splash solution onto the metal die, to closely control the volume of solution within the tank in order to provide a consistent exposure of the die to the solution.

One problem arising from the use of the conventional construction is that the tank typically requires a relatively large volume of solution, and it is always necessary to maintain this volume, even if the apparatus is to be used to etch only a single metal die. It is not possible to operate the apparatus with less than this required volume, and the entire volume of solution must be heated or cooled to the necessary temperature, and thereafter maintained at this temperature.

Another problem encountered with the conventional construction is that metal particles from the die fall from the die into the tank during an etching process and are re-projected onto the metal die by the paddle wheels or sprayers. These metal particles interfere with the desired chemical process between the solution and the metal die, and adversely effect the quality of the etching.

OBJECTS AND SUMMARY OF THE INVENTION

It is an object of the present invention to provide an acid etch apparatus having a relatively small bath within which only a portion of the total volume of acid etch solution is held, and a separate holding tank within which the remainder of the solution is stored during recirculation to the bath. This construction achieves the advantageous result of allowing the total volume of acid etch solution to be varied depending upon the needs of the user, eliminating the need for handling unnecessarily large volumes of dangerous acidic materials and reducing the cost of operating the apparatus.

It is another object of the present invention to provide an acid etch apparatus in which particles removed from the metal die by the etching process are drawn from the bath so that the particles may be dissolved before the solution bearing the particles is projected back onto the metal die.

In accordance with these and other objects evident from the following description of a preferred embodiment of the present invention, a metal die acid etch apparatus comprises a bath for holding an acid etch solution, a support means for supporting a metal die above the bath, and a means for exposing the metal die to the acid etch solution that is in the bath. In addition, a weir means having an upper edge positioned at a predetermined height within the bath allows the etching solution to overflow from the top of the bath. At least a portion of this overflow etching solution is recirculated back into the bath. A temperature control means is also provided for maintaining the temperature of the acid etch solution in the bath at a predetermined temperature.

Preferably, the apparatus includes a holding tank through which the acid etch solution is passed during recirculation, and the temperature control means maintains the temperature of the solution in the holding tank.

By providing a construction in accordance with the present invention numerous advantages are obtained. For example, by employing a weir means which allows overflow of acid solution from the top of the bath, it is possible to remove most of the particles of metal which fall into the bath from the die during the etching process so that these particles will not be projected or splashed back onto the die. Thus, the concentration of the solution is maintained.

Further, by providing for the recirculation of the acid etch solution which overflows from the top of the bath, it is possible to re-use the drained solution. Because the particles of metal drawn from the bath with the acid etch solution are allowed to dissolve during this recirculation step, they are no longer present in the solution upon introduction of the solution back into the bath. Thus, the problem of disposing of these particles is obviated.

An additional advantage is obtained through the use of a separate holding tank for the acid etch solution during recirculation. By providing this construction, the bath may be made relatively shallow as compared with conventional devices since it is only necessary for the bath to retain a volume of solution sufficient to supply the paddle wheels or sprayers in the apparatus. If many dies are to be etched, requiring a large volume of solution, the holding tank is filled completely, whereas if less solution is needed, e.g. for only a few etching operations, the holding tank is filled to a lower level sufficient to satisfy the decreased need. In this manner, only the amount of solution necessary to satisfy the needs of the user is used, obviating the need to handle unnecessarily large amounts of solution.

In addition, selective control over the amount of etching solution maintained in the apparatus allows the user of the equipment to more closely monitor the acidity of the etching composition, as well as the build up of dissolved metal therein, so that the quantity of makeup solution, or replacement of the composition as needed, may be more effectively regulated.

BRIEF DESCRIPTION OF THE DRAWING FIGURES

A preferred embodiment of the present invention is described in detail below with reference to the attached drawing figures, wherein.

DETAILED DESCRIPTION OF THE PREFERRED EMBODIMENT

Figure 1:
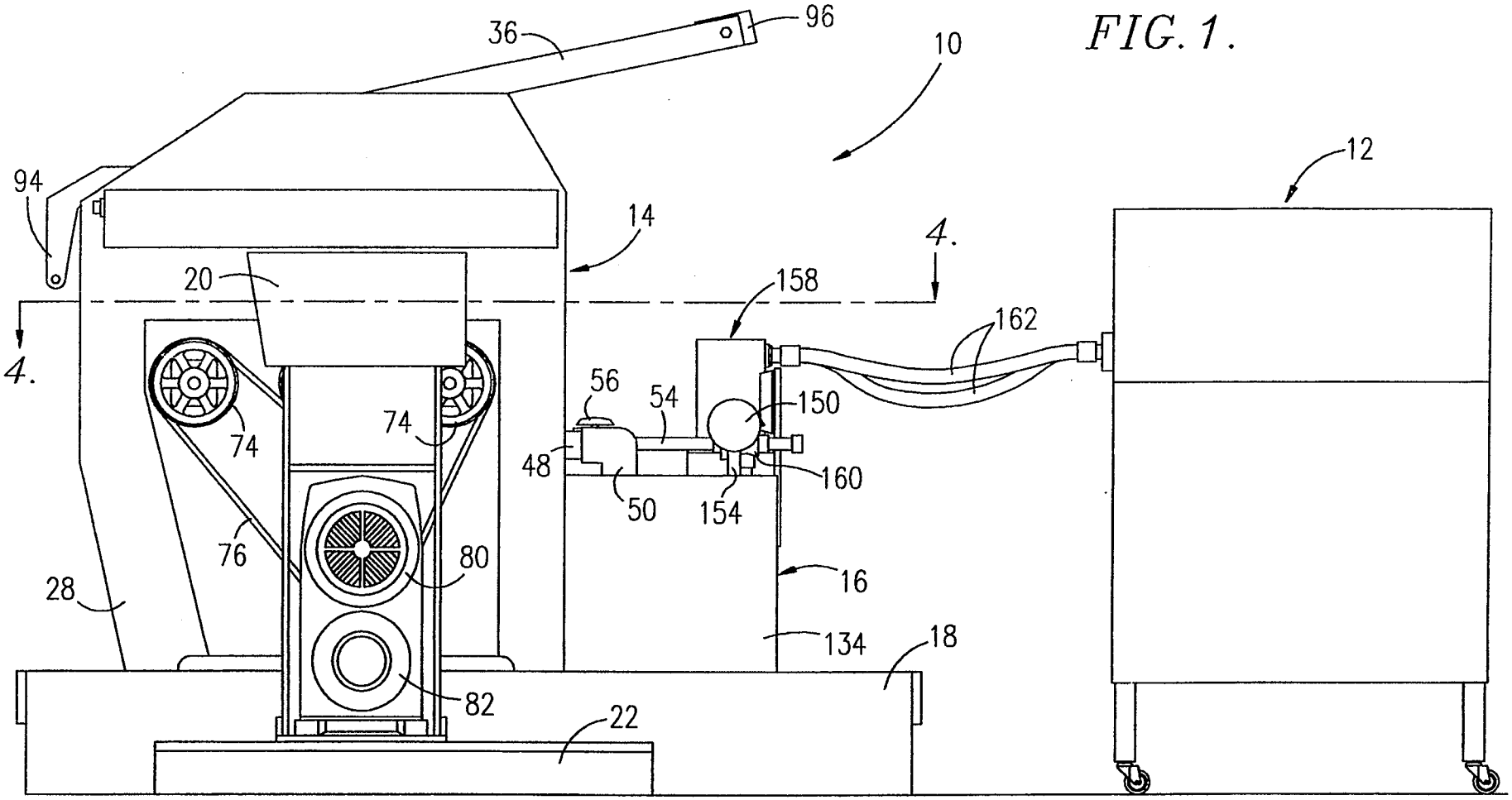
FIG. 1 is a side elevational view of an etching apparatus constructed in accordance with the preferred embodiment.

A metal die acid etch apparatus constructed in accordance with the preferred embodiment is shown in FIG. 1, and generally includes an etching unit 10 and a refrigeration unit 12.

The etching unit includes an upstanding frame 14, a holding tank 16, and a containment basin 18 within which the frame and tank are received. A control station 20 is supported on a platform 22 adjacent the basin and is connected to the etching unit by a belt drive assembly, described below.

Figure 2:
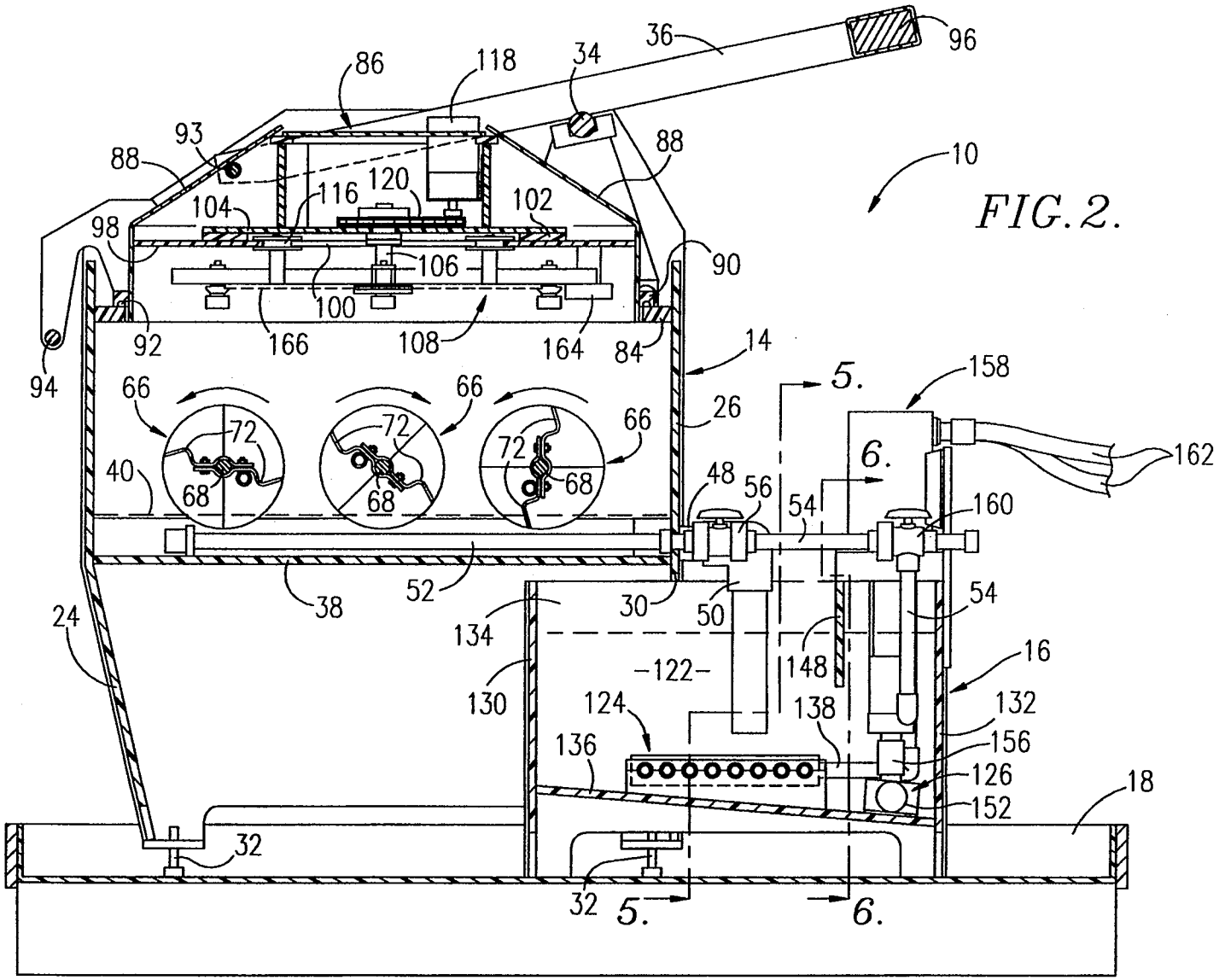
FIG. 2 is a side view of an etching unit of the apparatus, taken in section to show the interior of the unit.
Figure 3:
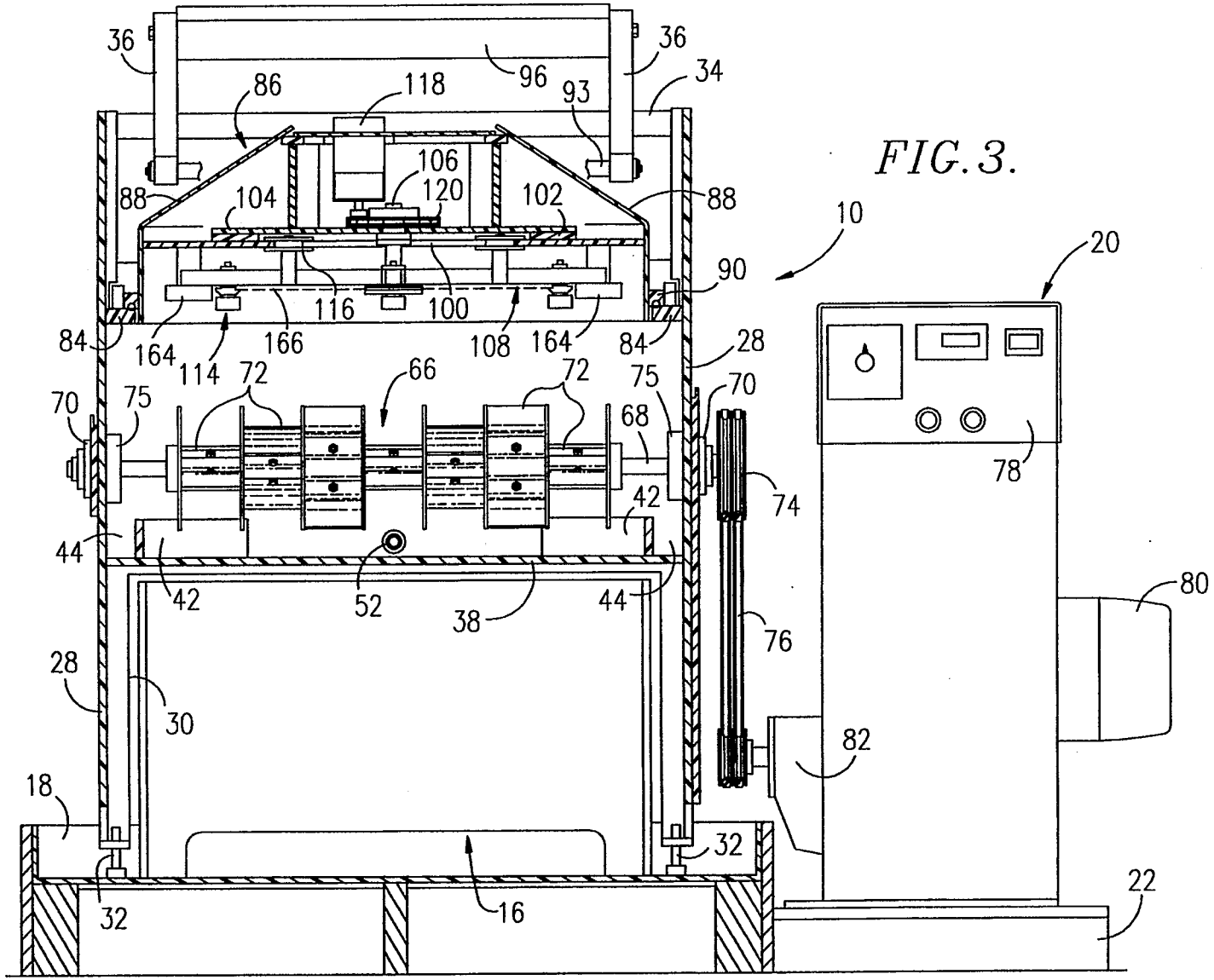
FIG. 3 is a front elevational view of the etching unit, partially taken in section to show the interior of the unit.
Figure 4:
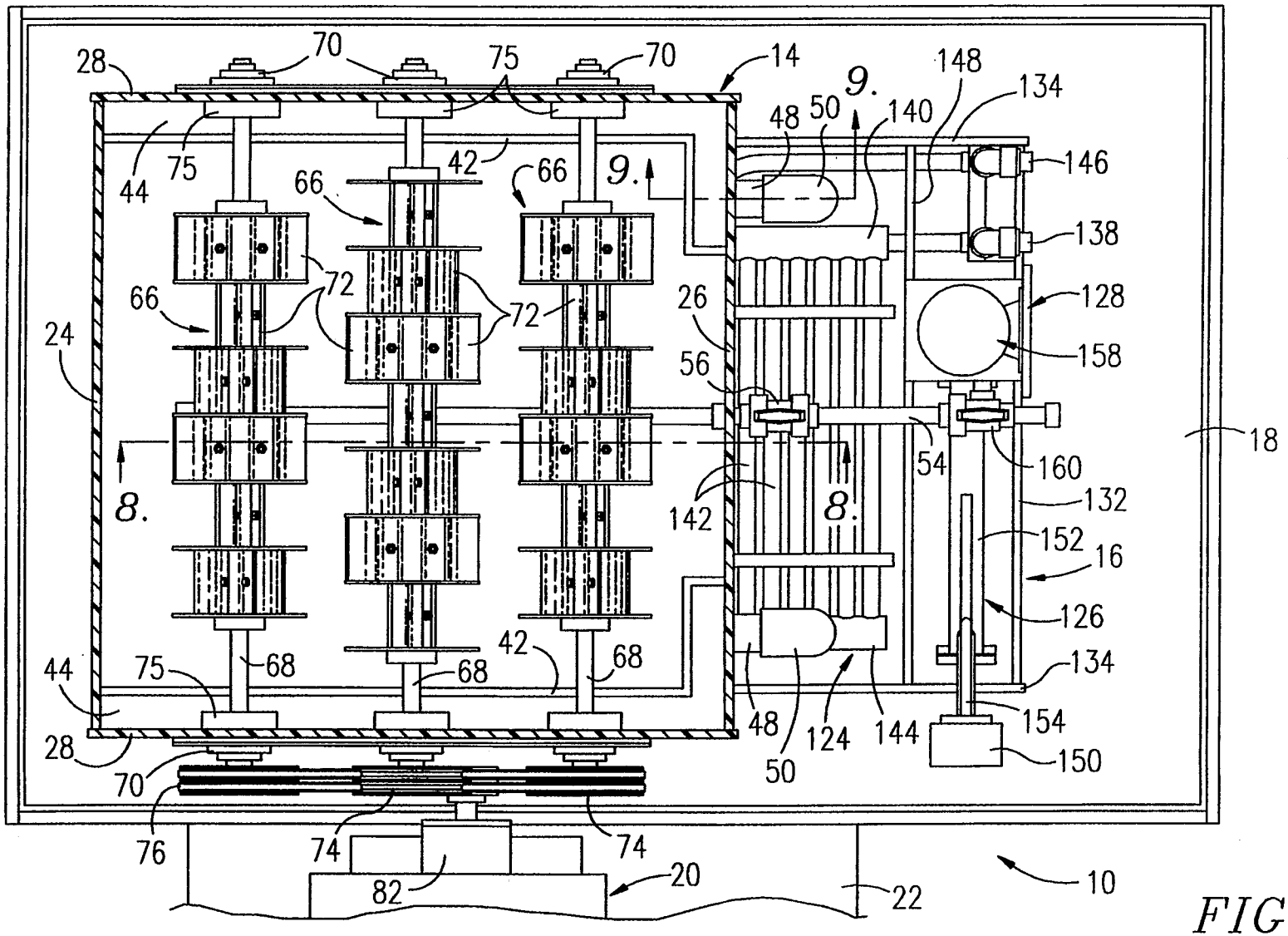
FIG. 4 is a sectional view of the etching unit taken along line 4—4 of FIG. 1.

As shown in FIG. 2, the frame 14 includes opposed upstanding front and rear walls 24, 26 which are connected together by side walls 28, illustrated in FIG. 3. The front wall 24 and side walls 28 substantially close off the interior of the frame, but the rear wall 26 is provided with a rectangular opening 30 adjacent the bottom of the frame for receiving the holding tank 16. A plurality of adjustable legs 32 may be provided on the bottom of the frame to permit the frame to be leveled within the basin 18.

The side walls 28 of the frame extend above the front and rear walls, and support a horizontal shaft 34 by which a counter balance arm 36 is supported on the frame. A horizontal floor 38 is provided within the frame above the opening 30 in the rear wall 26, and defines a bath for holding an acid etch solution. The bath is illustrated in more detail in FIGS. 8–10, and generally includes the floor 38 and the front, rear and side walls 24, 26, 28 of the frame 14.

As shown in FIG. 3, a weir means is positioned within the bath for overflow of acid solution from the top of the bath as the acid solution level, shown as dashed line 40, rises above the weir means. The weir means preferably includes a weir 42 extending along and spaced from each side wall 28 of the frame 14. These weirs 42 each have upper horizontal solution overflow edges and are formed by upstanding walls having a height equal to the desired depth of the bath. The weirs are spaced from the side walls of the frame by a distance sufficient to define return channels 44 along which acid etch solution flows, as indicated by arrows 46, after it has drained over the weirs 42 from the bath.

Figure 9:
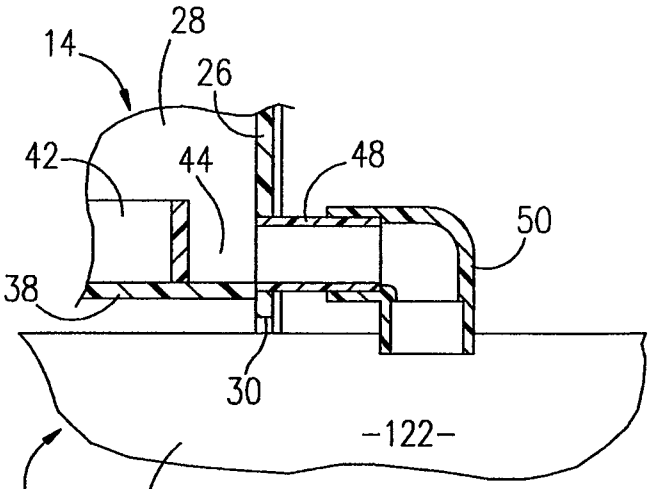
FIG. 9 is a sectional view of the bath of the etching unit, taken along line 9—9 of FIG. 4.

Preferably, each weir includes a short weir segment protruding outward from the side wall along the rear wall of the frame so that each channel 46 is connected to a return opening 48 extending through the rear wall 26. As shown in FIG. 9, each return opening 48 protrudes from the rear of the frame and is connected to a 90° elbow 50 which empties the acid etch solution into the holding tank 16.

Figure 10:
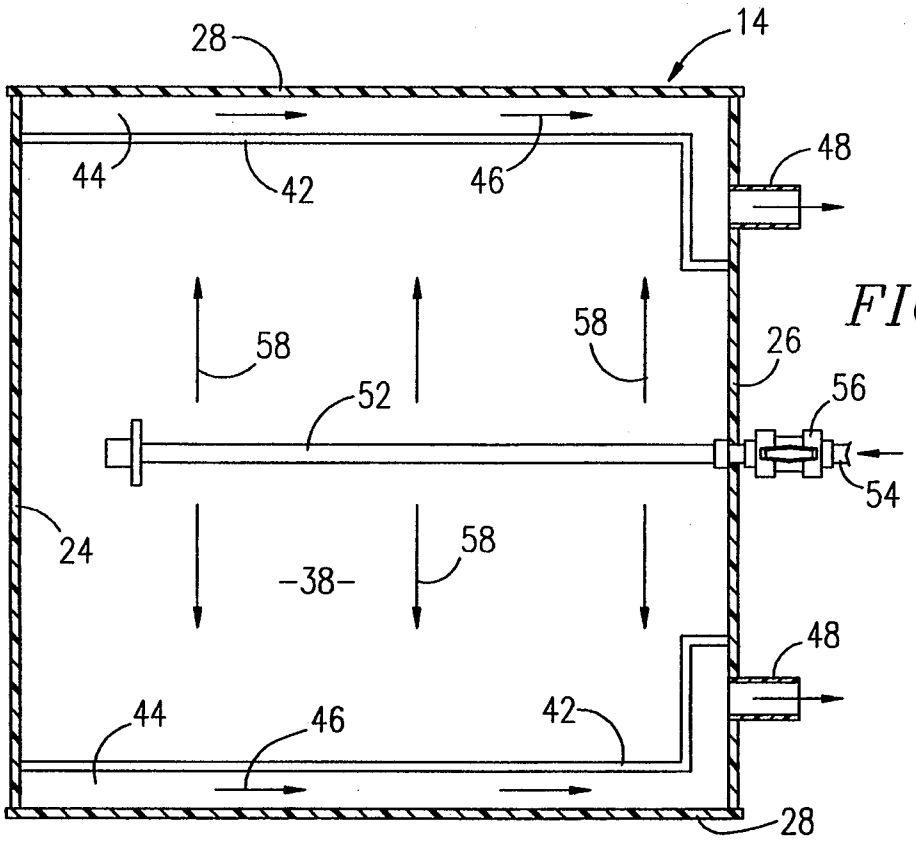
FIG. 10 is a top plan view of the bath, illustrating the direction of flow of acid etch solution through the bath.

As shown in FIG. 10, a distribution tube 52 is provided in the bath and extends through the rear wall 26 of the frame toward the front wall 24 along the center line of the bath. The distribution tube includes an inlet connected to a line 54 extending between the tube 52 and the holding tank 16. A valve 56 is disposed outside the rear wall of the frame for controlling flow to the distribution tube, and the tube includes a suitable means for distributing acid etch solution supplied to the tube throughout the area of the bath, as indicated by arrows 58.

Figure 8:
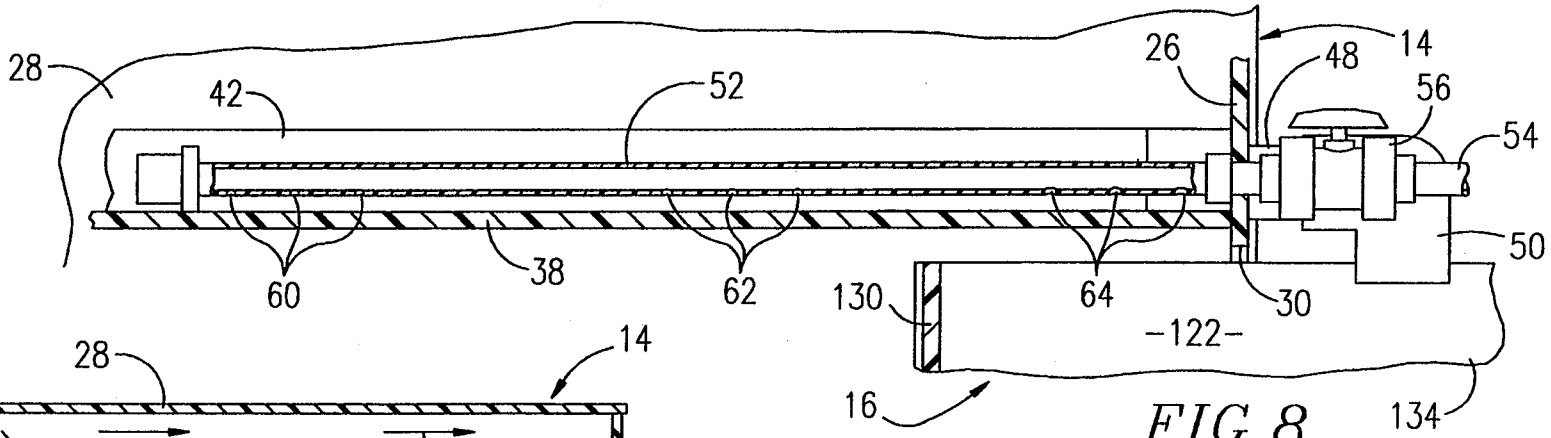
FIG. 8 is a sectional view of a bath of the etching unit, taken along line 8—8 of FIG. 4.

Turning to FIG. 8, the distribution means is illustrated as including three sets of orifices 60, 62, 64 provided along the length of the distribution tube and spaced longitudinally from one another. In addition, the distal end of the tube is closed to prevent fluid from being delivered from that end of the tube.

In order to even the distribution of solution along the length of the tube, the orifices 60, 62, 64 of each set are sized smaller than the orifices of the set next closest to the inlet of the distribution tube. For example, where the orifices 60 of the first set have a diameter of $\frac{1}{4}$ inches, the orifices 62 of the intermediate set have a diameter of 5/16 inches, and the orifices 64 of the rear set are formed of a diameter of $\frac{3}{8}$ inches.

As shown in FIG. 2, three paddle wheel units 66 are mounted on the frame above the bath. As shown in FIG. 3, each paddle wheel unit includes a shaft 68 supported by bearing assemblies 70 mounted on the side walls 28 of the frame, and a plurality of radially extending paddles 72. The paddles are arranged along the shaft 68 in pairs, with the paddles of each pair extending radially in a direction opposite to one another. In addition, each paddle pair is oriented at an angle relative to adjacent paddle pairs on the shaft so that all of the paddles will not dip into the bath simultaneously.

The shafts 68 of the paddle units are supported above the floor 38 of the bath at a height which presents the paddles 72 to the acid etch solution in the bath during rotation of the shafts. In this manner, the paddles pick up acid etch solution from the bath and project it radially outward and up onto an overlying plate. As shown in FIG. 3, each of the shafts 68 is provided with a pulley 74, and these pulleys are connected together by drive belts 76 connected between the pulleys and the control station 20. A splash bearing 75 supports each end of each shaft 68 within the frame, and prevents the corrosive acid etch solution from reaching the external bearing assemblies 70.

The control station 20 is shown in FIG. 3, and includes a user interface panel 78 for allowing input of operating parameters and for displaying various sensed conditions monitored by the apparatus. A motor 80 is supported on the tower and functions to drive the paddle units through a variable speed belt drive unit 82.

As shown in FIG. 2, a flange 84 is provided within the frame at a predetermined height above the bath adjacent the upper edges of the front and rear walls. The flange 84 extends inward from the front, rear and side walls of the frame, and defines a track on which a hood assembly 86 is supported.

The hood assembly 86 includes four similarly shaped walls 88 which form a hood sized for receipt within the space defined by the flange 84. An external, circumferential flange 90 extends around the hood, and includes a sealing member 92 which bears against the flange 84 of the frame to prevent acid etch solution from being splashed from the unit 10 between the hood assembly and frame.

A shaft 93 extends through the hood in a direction parallel to the shaft 34, and connects the hood to the counter-balance arm while allowing relative pivotal movement therebetween. Thus, as the hood is lifted, e.g. by a handle 94 provided at the front of the hood assembly 86, the hood pivots about the shaft 93 and the entire assembly and the counter-balance arm pivot about the shaft 34. In this manner, the hood is movable beyond a vertical orientation to an over center position in which the plate is exposed toward the front of the unit. As shown in FIG. 2, the arm 36 is provided with a weight 96 at the distal end for facilitating lifting of the hood.

The hood assembly 86 includes a bottom plate 98 connected to the walls 88 and presenting a central circular opening 100. An annular spacer 102 having an inner diameter slightly greater than the diameter of the opening 100 is attached to the top of the bottom plate and encircles the opening. A cover plate 104 is attached to the top of the annular spacer and substantially closes off the upper portion of the hood from the area beneath the bottom plate 98. A small central opening is formed in the cover plate, through which a drive shaft 106 extends. The drive shaft depends from the cover plate beneath the bottom plate, and a support frame 108 is attached to the shaft.

Figure 7:
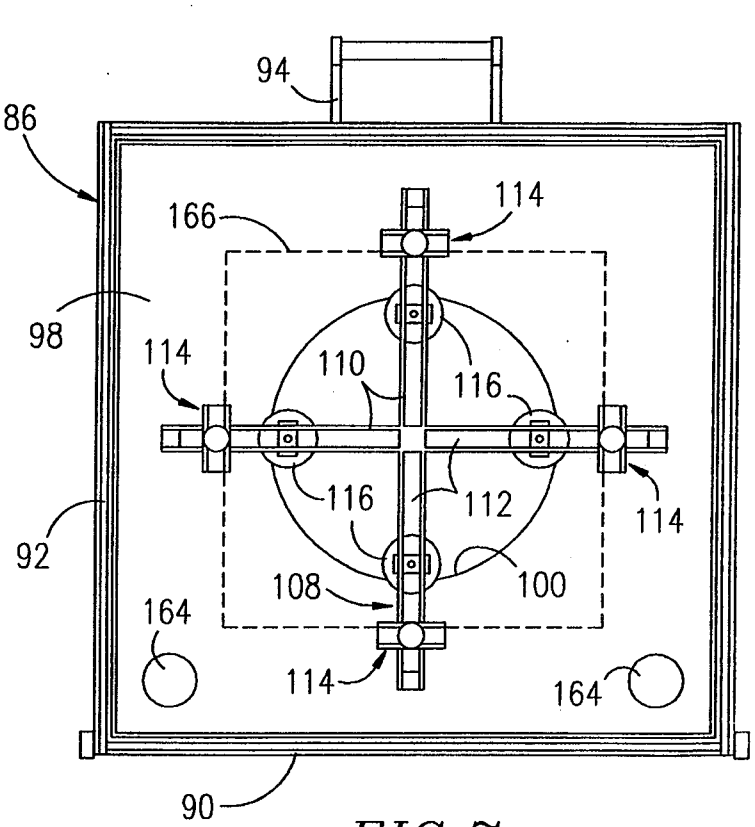
FIG. 7 is a bottom plan view of a hood assembly of the etching unit.

The support frame 108 is shown in FIG. 7, and includes four radially extending coplanar arms 110, each perpendicular to the next. Each arm includes an open, longitudinally extending area 112 within which a clamp assembly 114 is supported. Each clamp assembly 114 is movable along the length of the arm on which it is supported so that a metal die of any desired shape and size may be positioned on the frame and secured in place by the clamp assemblies 114. Four guide rollers 116 are also attached to the frame, and extend upwardly into the opening 100 of the bottom plate 98. As shown in FIG. 2, each roller 116 is grooved to receive the circular edge of the plate 98 while allowing and guiding rotation of the frame relative to the hood.

A drive means is provided on the hood assembly for rotating the drive shaft, frame, and any metal die supported thereon so that uniform exposure of the die to the acid etch solution is obtained. Preferably, this drive means includes a drive motor 118 having an output shaft connected to the drive shaft 106 by a chain 120.

The holding tank is illustrated in FIG. 2, and broadly includes a reservoir 122, a cooler 124, a heater 126, and a pumping means 128 for pumping fluid from the reservoir to the distribution tube 52. The reservoir includes front, rear and side walls 130, 132, 134 and a sloped bottom wall 136. Preferably, the holding tank stands alone so that it may be removed from the unit 10 and replaced by a larger or smaller holding tank, if necessary.

The cooler and heater together define a temperature control means for maintaining the temperature of the acid etch solution in the unit at a predetermined temperature. For example, in a conventional process, it may be necessary to maintain the temperature of the acid etch solution at 78° F. ±1. The cooler and heater are operated as needed to maintain this temperature.

Figure 5:
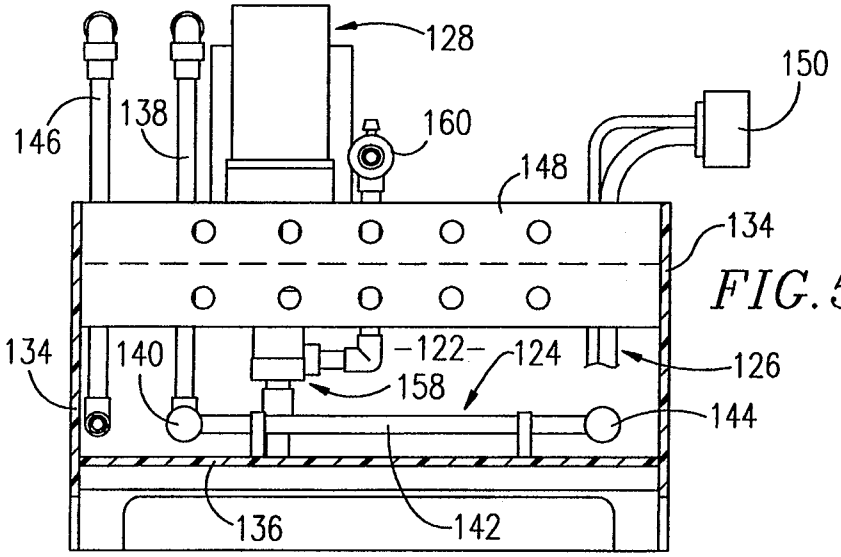
FIG. 5 is a sectional view of the etching unit taken along line 5—5 of FIG. 2.

The cooler 124 is illustrated in FIG. 5, and includes a cold water inlet 138, an inlet manifold 140, an outlet manifold 144 connected to the inlet manifold by a plurality of heat transfer tubes 142, and a warm water outlet 146. During use, cold water is supplied to the inlet 138 from the refrigeration unit 12 and passes through the manifold 140 to the heat transfer tubes 142. As acid etch solution within the reservoir contacts the tubes, heat is drawn from the solution and transferred to the water which is then delivered through the manifold 144 and the outlet 146. A baffle 148 is supported between the side walls 134 of the reservoir between the cooler 124 and the heater 126, and a plurality of holes may be formed in the baffle to allow acid etch solution to flow through and around the baffle.

Figure 6:
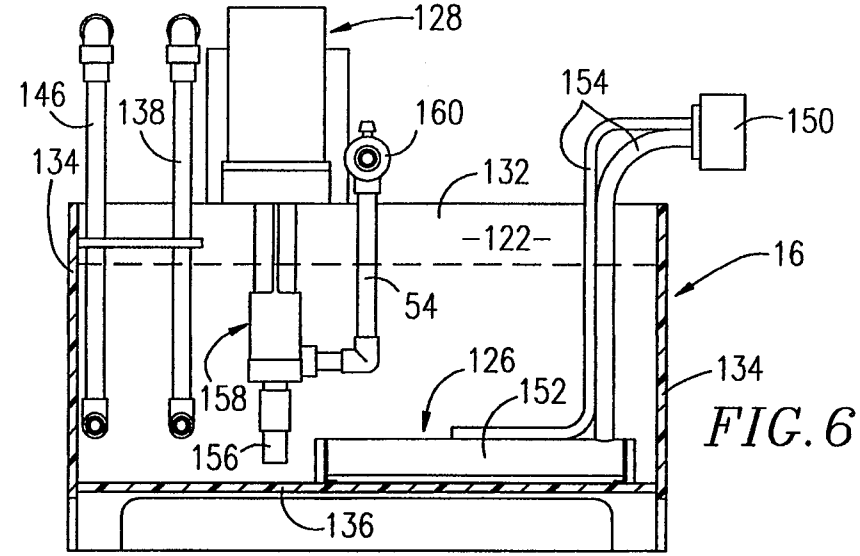
FIG. 6 is a sectional view of the etching unit taken along line 6—6 of FIG. 2.

The heater 126 is illustrated in FIG. 6, and preferably includes a submersible electrical resistance heater which rests on the floor 136 of the reservoir. The heater includes a connection 150 for attachment to a source of electrical power, a resistance heater unit 152 in the reservoir for transferring heat to the acid etch solution, and lines 154 between the connector and the heater for supplying electricity and control to the heater.

The pumping means 128 is also shown in FIG. 6, and includes an inlet 156 adjacent the bottom of the reservoir at the lowest point thereof, the fluid delivery line 54 extending between the inlet and the distribution tube 52, and a pump 158 within the line for pumping acid etch solution from the reservoir to the distribution tube 52. As shown in FIG. 2, a valved T-connector 160 may be provided in the line 54 for controlling the flow of acid etch solution to the distribution tube and for facilitating emptying of the unit.

The refrigeration unit 12 cools water for use in the cooler 124, and is connected to the cooler by flexible hoses 162. Thus, the refrigeration unit may be positioned anywhere relative to the etching unit, and is preferably kept outside of the corrosive environment presented by the acid etch solution in the etching unit 10. A freon refrigeration system is preferably employed in the unit, although it is possible to use any conventional refrigeration cycle.

The previously described construction of the etching unit presents a shallow bath through which acid etch solution is recirculated. During an etching process, the path along which the acid etch solution is circulated is as follows: Initially, solution is introduced into the bath through the orifices 60, 62, 64 in the distribution tube 52. These orifices direct the solution downward toward the floor 38 of the bath and outward toward the side walls 28. As the level of acid etch solution rises within the bath, the solution cascades over the weirs 42 into the channels 44 and is emptied through the discharge elbows 50 into the holding tank 16. Solution within the holding tank is heated or cooled as required, and is then pumped back through line 54 to the distribution tube for introduction again into the bath.

In order to carry out an etching operation, the hood of the unit 10 is lifted and pivoted to an open position presenting the frame 108 to a user located in front of the unit. As shown in FIG. 7, a pair of handles 164 depend from the bottom plate 98 of the hood to facilitate this opening movement.

A metal die, indicated by dashed line 166 in the figures, is positioned on the frame 108 and clamped in place by the clamping assemblies 114, with the surface of the die to be etched facing outward away from the hood. Thereafter, the hood is pivoted back to the lowered position shown in FIGS. 2 and 3, with the metal die disposed immediately over the bath.

The etching process is commenced by initiating rotation of the die by energizing the motor 118, and by driving the paddle units 66. As the paddles of the units rotate through the bath, acid etch solution is picked up by the paddles and thrown radially outward and upward against the die. The solution etches the surface of the die in a conventional fashion and removes material from the die.

If any particles of metal are returned to the solution, the particles are carried on top of the solution over the weirs 42 and from the bath. Before the particles are recirculated back into the bath, sufficient time has passed for the particles to dissolve into the solution, thus preventing the particles from being projected back onto the die.

Although the invention has been described with reference to the preferred embodiment illustrated in the attached drawing figures, it is noted that substitutions may be made and equivalents employed herein without departing from the scope of the invention as recited in claims.

What is claimed is:

1. A metal die acid etch apparatus comprising:

a bath for holding an acid etch solution;

a support means for supporting a metal die above the bath;

a means for exposing the metal die to the acid etch solution that is in the bath;

a weir means having an upper edge positioned at a height within the bath for overflow of acid solution from the top of the bath;

a recirculation means for recirculating acid etch solution which overflows the weir means to return at least a portion of such overflow back into the bath; and a temperature control means for maintaining the temperature of the acid etch solution in the bath at a temperature.

2. A metal die acid etch apparatus as recited in claim 1, further comprising a holding tank within which the acid etch solution is stored during recirculation, and fluid delivery means for emptying acid etch solution which overflows from the top of the bath into the holding tank, the recirculation means drawing acid etch solution from the holding tank and introducing it back into the bath.

3. A metal die acid etch apparatus as recited in claim 2, wherein the recirculation means includes a pump for pumping acid etch solution from the holding tank into the bath.

4. A metal die acid etch apparatus as recited in claim 1, wherein the bath includes a floor and upstanding side walls, and the recirculation means includes a distribution tube extending along the floor of the bath, the distribution tube including a plurality of laterally and longitudinally spaced orifices for substantially evenly distributing acid etch solution across the bottom of the bath.

5. A metal die acid etch apparatus as recited in claim 2, wherein the temperature control means adjusts and maintains the temperature of the acid etch solution in the holding tank.

6. A metal die acid etch apparatus as recited in claim 5, wherein the temperature control means includes a heater and a cooler, both positioned in the holding tank.

7. A metal die acid etch apparatus as recited in claim 6, wherein at least said cooler is located remotely from said bath in disposition away from the corrosive atmosphere surrounding the bath.

8. A metal die acid etch apparatus as recited in claim 1, wherein the bath includes a floor and upstanding side walls, the weir means including an upstanding wall spaced from the side walls of the bath and defining a return channel within which acid etch solution flows from the bath as the solution drains over the upstanding wall from the top of the bath.

9. A metal die acid etch apparatus as recited in claim 7, wherein a separate upstanding wall is provided along opposite sides of the bath floor, each of the upstanding walls defining a separate return channel.

10. A metal die acid etch apparatus as recited in claim 8, wherein the recirculation means is connected to each return channel for recirculating the acid etch solution within the channels to the bath.

11. A metal die acid etch apparatus as recited in claim 1, wherein the support means is movable between a loading position in which the metal die is accessible from outside the apparatus, and an etching position in which the metal die is disposed immediately over the bath.

12. A method of acid etching a metal die comprising the steps of:

positioning a metal die above a bath of acid etch solution; exposing the metal die to the acid etching solution that is in the bath;

allowing acid solution to overflow at a level from the top of the bath;

recirculating at least a portion of the acid etch solution which overflows from the bath back into the bath; and maintaining the temperature of the acid etch solution at a temperature.

13. A method as recited in claim 11, wherein the recirculation step further includes the steps of emptying acid etch solution which overflows from the top of the bath into a holding tank, and drawing at least a portion of acid etch solution from the holding tank and introducing it back into the bath.

14. A method as recited in claim 12, wherein the recirculation step includes pumping acid etch solution from the holding tank into the bath.

15. A method as recited in claim 11, wherein the recirculation step includes introducing the recirculated acid etch solution at the bottom of the bath, and distributing the solution substantially evenly throughout the bath.

* * * * *